United States Patent [19]

Rassmann et al.

[11] Patent Number: 4,762,372

[45] Date of Patent: Aug. 9, 1988

[54] CUTTER-BIT ASSEMBLIES

[75] Inventors: Christoph Rassmann, Lünen; Oswald Breuer, Dortmund; Bernd Steinkuhl, Lünen, all of Fed. Rep. of Germany

[73] Assignee: Gewerkschaft Eisenhutte Westfalia GmbH, Lunen, Fed. Rep. of Germany

[21] Appl. No.: 24,620

[22] Filed: Mar. 11, 1987

[30] Foreign Application Priority Data

Mar. 15, 1986 [DE] Fed. Rep. of Germany ..... 3608786

[51] Int. Cl.[4] ..... E21B 10/00

[52] U.S. Cl. ..... 299/91; 37/142 A; 299/93

[58] Field of Search ..... 299/91, 92, 93; 137/142 A

[56] References Cited

U.S. PATENT DOCUMENTS 3,063,691 11/1962 Osgood ..... 299/92
4,455,771 6/1984 Poncin ..... 37/142 A
4,456,307 6/1984 Merten et al. ..... 299/93
4,609,227 9/1986 Wild et al. ..... 299/93
4,626,034 12/1986 Brever et al. ..... 299/92 X

FOREIGN PATENT DOCUMENTS 3518045 9/1985 Fed. Rep. of Germany .

*Primary Examiner*—Stephen J. Novosad
*Assistant Examiner*—David J. Bagnell
*Attorney, Agent, or Firm*—Samuels, Gauthier, Stevens & Kehoe

[57] ABSTRACT

A cutter-bit assembly employs an arcuate wedge to secure a cutter-bit within a pocket of a holder. The wedge fits into a tapered gap between complementary curved surfaces of the holder and the cutter-bit shank. A projecting insert carried by the shank mates with a serrated portion on the wedge. Contact is established between the wedge and the curved surfaces of the holder and the shank over outer regions separated by non-contacting clearances.

8 Claims, 4 Drawing Sheets

53
53
50
51
52

CUTTER-BIT ASSEMBLIES

FIELD OF THE INVENTION

The present invention relates to cutter-bit assemblies for use particularly in mining.

BACKGROUND TO THE INVENTION

Cutter-bit assemblies of various designs are widely used in mining and tunnelling operations. Normally, such assemblies are composed of a holder secured to a cutting appliance or machine, such as a coal plough, and a separate cutter-bit which is inserted into a pocket in the holder. To secure the cutter-bit within the holder it is known to employ a wedge element which jams a shank of the cutter-bit in the pocket. U.S. Pat. Nos. 4,456,307 and 4,626,034 and German Gebrauchsmuster No. G 35 18 045.9 describe assemblies which use an arcuate tapered wedge. During use however and especially when the assembly is subjected to impact stress, deformation and wear can cause loosening of the wedge and the cutter-bit and chattering and damage can occur. The service life of the cutter-bits can be improved significantly if the means used to secure the cutter-bits in the holders is made more reliable and the above-mentioned publications describe various measures which can be adopted to lock the arcuate wedge in position. Nevertheless, although such measures greatly reduce the tendency of the wedge to work loose this still occurs from time to time. A general object of the invention is to provide an improved form of cutter-bit assembly.

SUMMARY OF THE INVENTION

A cutter-bit assembly constructed in accordance with the invention comprises a holder defining an open pocket, a cutter-bit having a shank detachably mounted in the pocket, complementary curved surfaces on the shank and the holder which provide an arcuate tapered gap between the shank and an inner face of the pocket, bearing means between the shank and the holder opposite the gap and a tapered wedge component fitted in the gap. Instead of adopting regular contact surfaces between the wedge component and the shank and the holder, in accordance with the invention at least one of these respective curvilinear surfaces is relieved to provide positive clearance between the wedge component and the complementary surface over a central region which separates proper contacting regions. By providing such clearance a more reliable securing system can be realized especially if the wedge component is serrated to provide teeth which engage with a projecting plastics insert incorporating a metal pin or tube carried by the cutter-bit shank as in known per se.

In practice, with the prior art designs, it is difficult to ensure uniform contact between the curved contacting surfaces due to inaccuracies in manufacturing. Consequentially, the known system with regular surfaces does not provide precisely defined force transmission points. It can be assumed that the main clamping force in this known assembly is transmitted approximately in a plane between the rear supporting point of the cutter-bit shank in the holder and the central zone of the arcuate wedge component. In the prior art designs, therefore, the system by which the cutter bit is clamped in the compartment or pocket is in practice of the two-point type. The measures according to the invention, convert this non-defined two-point clamping system into an exactly defined triangular three-point system. The surface by which the curved wedge rests against the cutter bit shank and also against the interior of the cutter compartment or pocket is considerably increased so that the self-locking action of the curved wedge in the gap is improved. Furthermore, the cutter bit shank is subjected to the clamping force far more evenly and the risk of shank breakage is practically eliminated. Finally, the so-called "cherry-stone effect", tending to expel the arcuate wedge component from the wedge gap as a result of the vibrations occurring in operation, is greatly reduced.

According to the invention, the central zone of the curved wedge can be caused to have clearance relative to the interior surface of the front wall or web of the holder as a result of the fact that the concave inner surface in the central zone of the curved wedge recedes dimensionally to some extent in relation to the convex outer surface of the web of the cutter holder. The same effect is obtained if that zone of the convex outer surface of the web of the cutter holder recedes dimensionally to some extent in relation to the concave inner surface of the curved wedge. According to further characteristics of the invention the central zone of the curved wedge can have clearance relative to the curved surface of the cutter-bit shank as a result of the fact that the convex surface in the central zone of the curved wedge recedes dimensionally to some extent in relation to the concave surface of the shank or if a partial zone of the concave surface of the shank does so in relation to the convex surface of the curved wedge. Although in principle one of the aforementioned measures according to the invention suffices for the desired effect, the invention also allows of combinations of these measures. For example, if the central zone of the curved wedge recedes dimensionally in relation to the curved surface of the shank and also in relation to the front web wall of the holder, this offers the advantage that the curved wedge thus gains flexural elasticity, so that it can adapt itself particularly well to the existing wedge gap and the clamping force can be advantageously distributed over the two outer zones of the curved wedge.

Although the optimum clamping effect obtained for the cutter in the holder according to the invention renders it highly improbable that the curved wedge will work loose, it may nevertheless be desirable, for the sake of extra safety, to adopt the additional measures mentioned above to secure the curved wedge in position in the wedge gap. A practical design provides a blind boring in the shank which accommodates a plastics locking element or plug projecting towards the convex surface of the curved wedge. The plastics locking member is preferably provided at the rear with a projection of smaller diameter which engages in a stepped recess at the base of the blind boring. This construction serves to enable the diameter required for the plastic locking member to be kept at a minimum without the risk that the said plastics locking member will be rotated out of position in the plane of the cutter-bit shank when the curved wedge is driven in. The resultant reduction in the diameter of the blind boring as a result of this measure ensures that any weakening of the shank as a result of the blind boring is reduced to a minimum, thus still further reducing the danger of breakage.

The plastics locking member can correspond either to the actual convex surface of the curved wedge or with particular advantage to notches or serrations formed in a manner known per se in the central zone of the convex surface of the curved wedge. According to a further characteristic of the invention, the notches are only provided in the central part of the width of the curved wedge, so that the latter will not unnecessarily weaken. A metallic securing pin is best provided in the plastics locking element and preferably rests by its rear end in a throat between that part of the boring which has the greater diameter and the recess in the base of the blind boring. The aforementioned measures according to the invention secures the curved wedge still more firmly in position, as it can only be unclamped by deformation of the securing pin and/or the locking member.

The invention may be understood more readily, and various other aspects and features of the invention may become apparent, from consideration of the following description.

BRIEF DESCRIPTION OF THE DRAWINGS

Embodiments of the invention will now be described, by way of examples only, with reference to the accompanying drawings, wherein.

DESCRIPTION OF PREFERRED EMBODIMENTS

Figure 1:
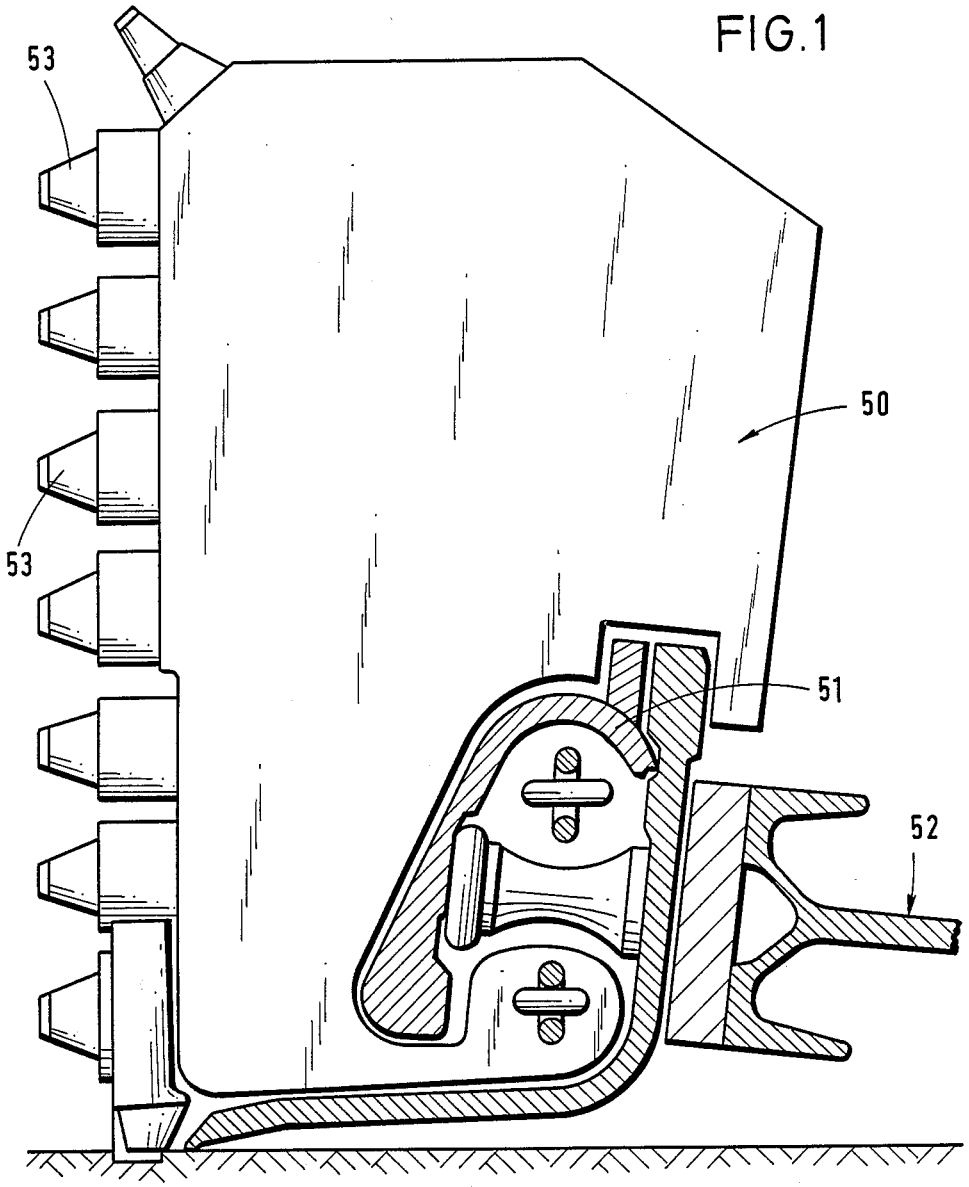
FIG. 1 is a part-sectional end view of a mineral winning machine equipped with cutter-bit assemblies constructed in accordance with the invention.
Figure 2:
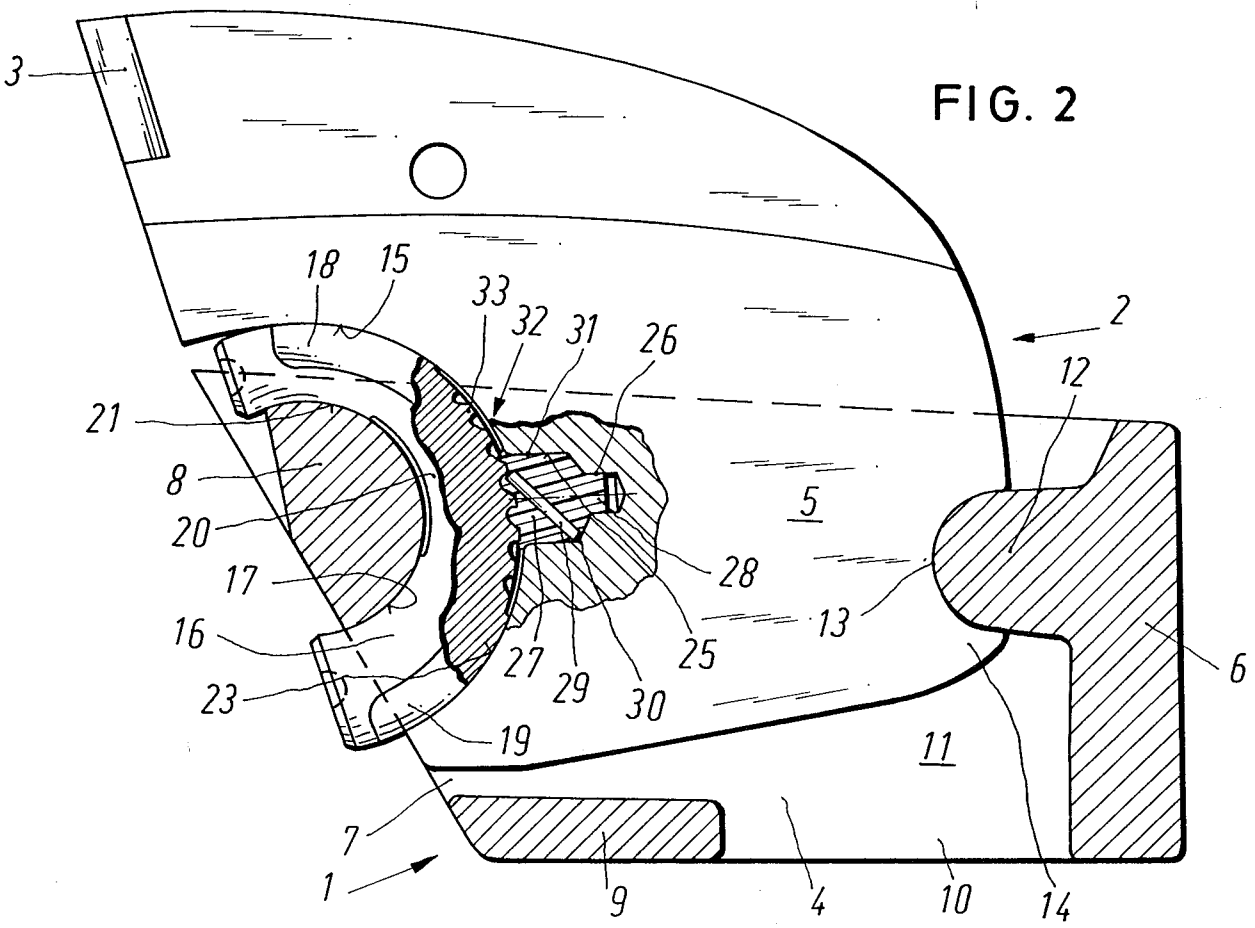
FIG. 2 is a part-sectional side view of a cutter-bit assembly constructed in accordance with the invention.
Figure 4:
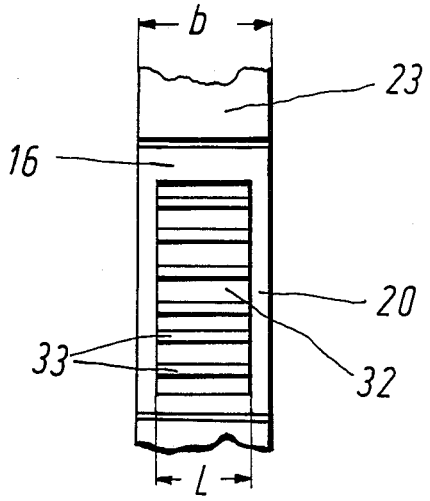
FIG. 4 is a view of part of the wedge component taken in the direction of arrow A in FIG. 3.
Figure 5:
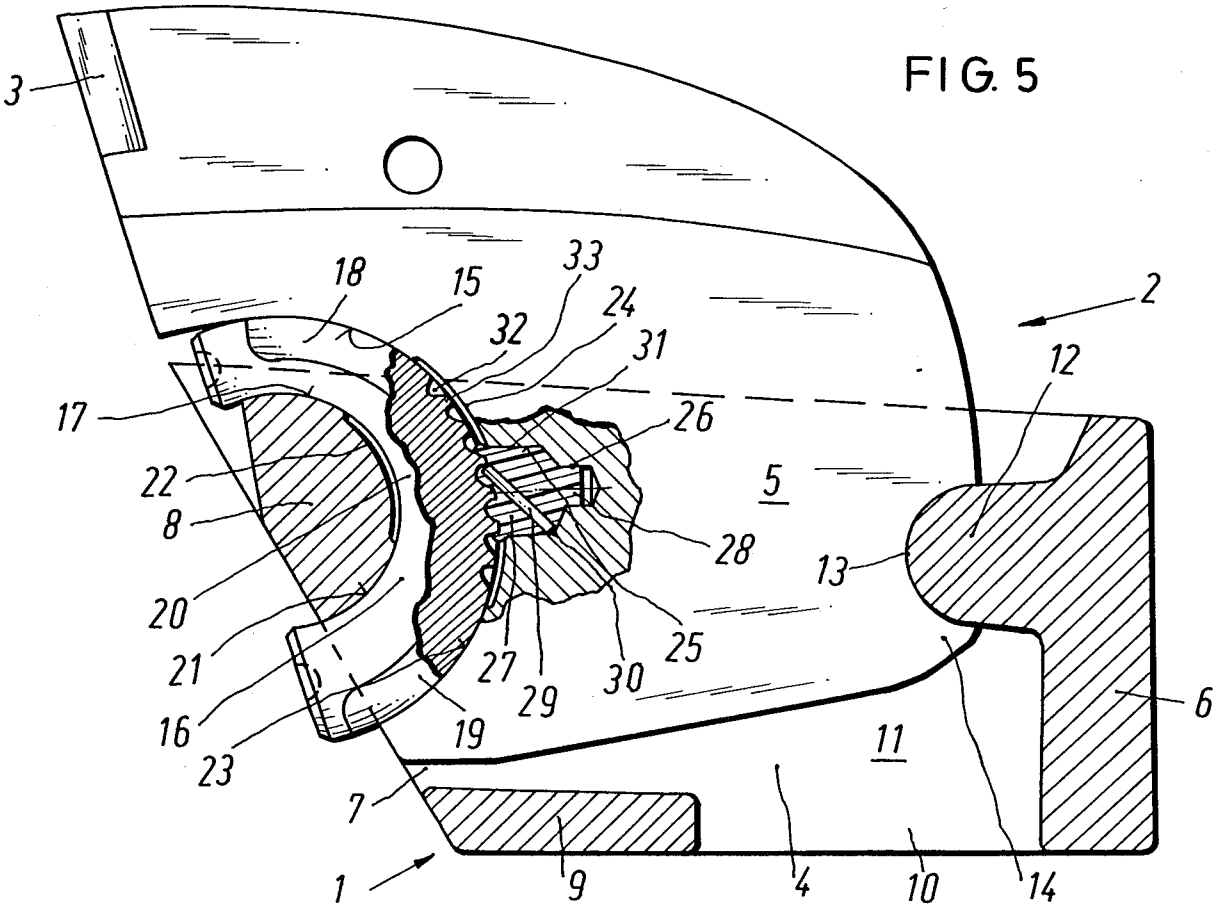
FIG. 5 is a part-sectional side view of a further cutter-bit assembly constructed in accordance with the invention.

FIG. 1 of the accompanying drawings depicts a typical mineral, e.g. coal, winning machine in the form of a plough 50. The plough 50 is guided for movement back and forth alongside a mineral face on a guide 51 at the mineral face side of a scraper-chain conveyor 52. The plough 50 is equipped with cutting tools 53 in the form of cutter-assemblies as described hereinafter. As shown in FIGS. 2 and 5 in conjunction with FIGS. 3 and 4, in which like reference numerals denote like and analogous parts, a cutter-bit assembly is composed of a holder 1, a cutter-bit 2 and locking means including an arcuate wedge component 16 for retaining the cutter-bit 2 in the holder 1. The holder 1 is normally fixed, e.g. welded, or detachably secured to a support of the plough 50 or some other cutting appliance. The cutter-bit is a shaped metal plate with a shank portion 5 received in the holder 1 and an external portion carrying a hard-metal insert 3 forming a cutting edge. The shank 5 locates within a pocket 4 defined in the holder 1. The holder 1 is of generally rectangular configuration with a rear wall 6 and an apertured front wall 8 nearest the cutting edge of the cutter-bit 2 as well as an apertured bottom wall 9. These walls 6, 8, 9 are interconnected by parallel side walls 11 to define the pocket 4. Access to the pocket 4 is via its open top opposite the wall 9. The front wall 8 which forms a web has an opening 7 near the bottom wall 9 and the bottom wall 9 has an opening 10 adjacent the rear wall 6. The side walls 11 are interconnected by means of a transverse rib 12 integral with the rear wall 6. A separately-formed pin or rod can be used instead of the integral rib 12. The shank 5 of the cutter-bit 2 has a semi-circular recess 13 in its rear face which mates with the rib 12. As the shank 5 is being introduced in the pocket 4 the recess 13 initially contacts the rib 12 and permits the shank 5 to swivel about the rib 12 to bring the shank 5 into its correct disposition. When locked in place the lower region of the shank 5 beneath the recess 13 forms a nose which engages in a hook-like manner beneath the rib 12.

At the front end region of the shank 5 opposite the recess 13, the shank 5 is shaped to possess an arcuate face 15. This face 15 co-operates with a complementary rear curvilinear surface 17 of the web or front wall 8 to define an arcuately tapered gap which narrows progressively in a direction toward the external portion of the cutter-bit 2. The gap receives the corresponding arcuately-shaped wedge component 16 via the opening 7 and the component 16 jams the cutter-bit 2 in the holder 1. The component 16 typically forms an arc of approximately 180° to 200°. The component 16 is removable via the opening 7. During assembly, the shank 5 is placed into the pocket 4 from the rear with its recess 13 engaged on the rib 12. The front of the cutter-bit 2 is then swung downwards into the pocket 4 and the component 16 is driven into the gap via the opening 7 to wedge therein.

As shown in FIGS. 2 and 5, the contact surfaces between the exterior of the component 16 and the corresponding surface 15, 17 of the shank 5 and the web 8 are not regular. Instead outer end zones 18, 19 of the component 16 contact the surfaces 15, 17 while a small central space or clearance exists between the component 16 and the surfaces 15, 17. In the construction illustrated in FIGS. 2 to 4, the clearance is created by relieving the exterior of the component 16 at least on the concave inner face 21 of its central region 20 and preferably on the convex outer face 23 as well. In FIG. 5, the clearance is created by relief of the convex surface 17 of the web 8 over a region 22 and preferably by relief of the concave surface 15 of the shank 5 as well.

Figure 3:
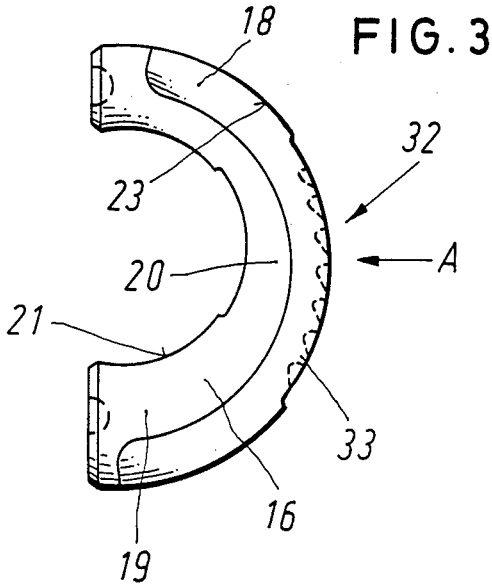
FIG. 3 is a view of the wedge component of the assembly shown in FIG. 2.

The wedge action of the compoonent 16 is supplemented by additional retention or locking means which will now be described. As shown in FIGS. 2 and 5, the shank 5 of the cutter-bit 2 is provided with a blind bore 25 penetrating the surface 15 and the bore 25 has a further recess 26 at its inner end wall. A resilient insert 27 conveniently made from synthetic plastic is shaped to fit in the bore 25 and the recess 26. A metallic locking element 29 in the form of a pin or tube is embedded in the insert 27 and extends at an angle to the axis of the bore 25. The rear end of the element 29 engages on the juncture 30 between the peripheral side wall 31 of the bore 25 and an inclined base wall leading to the recess 26. The insert 27 and the element 29 project by a small amount, e.g. 1–2 mm, from the surface 15 of the shank 5. In both embodiments, the component 16 has a series of notches or serrations 32 providing projections or teeth 33 over a central portion of its convex face 23. In the case of the first embodiment, the serrations 32 lies on the relieved region of the component 16 and in the case of the second embodiment (FIG. 5) the serrations 32 are not so set-back since the relief is provided on the shank surface 15. As shown in FIGS. 3 and 4, the teeth 33 do not extend over the entire width of the component 16 but the serrations are confined to a central part L of the component 16. In both embodiments, the teeth 33 are shaped to co-operate with the insert 27 and the element 29 so that there is minimal resistance when the component 16 is driven into the reception gap between the surfaces 15, 17 but maximum resistance to withdrawal of the component 16. Preferably, the plastics material of the insert 27 is squeezed into the gaps between the teeth 33 in shaped-locked fashion while the element 29 rigidly locks against one of the teeth when the component 16 is inserted. Consequentially, the component 16 can only be removed by deforming and perhaps destroying the element 29 and by shearing off the deformed end of the insert 27.

We claim:

1. In a cutter-bit assembly comprising a holder defining an open pocket, a cutter-bit having a shank detachably mounted in the pocket, complementary curved surfaces on the shank and the holder which provide an arcuate tapered gap between the shank and an inner face of the pocket, bearing means between the shank and the holder opposite the gap and a tapered wedge component fitted in the gap; the improvement comprising there being contact directly between the exterior of the wedge component and at least one of the complementary curved surfaces over end zones separated by a clearance between the exterior of the wedge component and said at least one curved surface.

2. A cutter-bit assembly according to claim 1, wherein said clearance is created at least in part by relief of a region of the exterior surface of the wedge component.

3. A cutter-bit assembly according to claim 1, wherein said clearance is created at least in part by relief of a region of the curved surface of the shank.

4. A cutter-bit assembly according to claim 1, wherein said clearance is created at least in part by relief of the curved surface of the holder.

5. A cutter-bit assembly according to claim 1, wherein the curved surface on the shank contains a bore in which an insert made from plastics material is mounted and the wedge component has a serrated surface portion which cooperates with the insert in jamming the cutter-bit shank in the pocket.

6. A cutter-bit assembly according to claim 5, wherein the bore is a blind bore with a base wall in which there is a recess of smaller cross-section than the bore and the insert is shaped to fit in the blind bore and the recess.

7. A cutter-bit assembly according to claim 6, wherein a metallic locking element is embedded in the insert and extends from an outer surface of the insert adjacent the serrated surface portion to abut on a shoulder between the base wall and the peripheral surface of the blind bore.

8. A cutter-bit assembly comprising a holder with a front wall, a rear wall, a base wall and side walls defining a generally rectangular pocket, an opening opposite the base wall permitting access to the pocket, a projection on the interior of the rear wall, a convex surface on the interior of the front wall, a cutter-bit having a shank received in the pocket and a portion exterior to the pocket provided with a cutting edge, a concave surface on the exterior of the shank facing the convex surface, an arcuate tapered gap defined by the concave and convex surfaces, a recess on the shank opposite the concave surface thereof engaging with the projection on the rear wall of the holder, and an arcuate wedge element fitted in the gap, the wedge element having a concave surface and a convex surface, the convex surface of the wedge element forming with the concave surface of the shank a pair of complementary surfaces, one of the complementary surfaces being provided with serrations forming teeth and the other of the complementary surfaces being provided with an insert projecting beyond the surface to engage with the teeth; wherein at least one or more of the concave and convex surfaces of the wedge element and of the shank and front wall of the holder is relieved over a central region only to provide thereat relative clearance between mating contact faces of the wedge element and the shank or the front wall of the holder.

* * * * *